US011103979B2

(12) United States Patent
Li

(10) Patent No.: US 11,103,979 B2
(45) Date of Patent: Aug. 31, 2021

(54) ONE-WAY OPEN-END WRENCH

(71) Applicant: Yi-Min Li, Taichung (TW)

(72) Inventor: Yi-Min Li, Taichung (TW)

( * ) Notice: Subject to any disclaimer, the term of this patent is extended or adjusted under 35 U.S.C. 154(b) by 309 days.

(21) Appl. No.: 16/221,550

(22) Filed: Dec. 16, 2018

(65) Prior Publication Data

US 2020/0189074 A1 Jun. 18, 2020

(51) Int. Cl.
*B25B 13/46* (2006.01)
*B25B 13/08* (2006.01)

(52) U.S. Cl.
CPC ..... *B25B 13/46* (2013.01); *B25B 13/08* (2013.01)

(58) Field of Classification Search
None
See application file for complete search history.

(56) References Cited

U.S. PATENT DOCUMENTS

2012/0272796 A1* 11/2012 Hu ..... B25B 13/46 81/179

* cited by examiner

*Primary Examiner* — Brian D Keller

(57) ABSTRACT

An open-end wrench includes a handle and a movable jaw. The handle includes an open end formed with a root, a first stationary jaw extending from the root, and a second stationary jaw extending from the root. The movable jaw is connected to the second stationary jaw and moveable between an idle position and an active position relative to the second stationary jaw. The movable jaw includes an operative face that includes a first planar facet and a second planar facet extending at an angle relative to the first planar facet. The first and second planar facets are respectively in contact with two adjacent sides of a hexagonal head in the active position.

5 Claims, 7 Drawing Sheets

ONE-WAY OPEN-END WRENCH

BACKGROUND OF INVENTION

1. Field of Invention

The present invention relates to an open-end wrench and, more particularly, to a one-way open-end wrench.

2. Related Prior Art

A conventional open-end wrench is operable to rotate a nut or a threaded bolt. The nut includes a hexagonal periphery, and the threaded bolt includes a hexagonal head. That is, the nut or the head of the threaded bolt includes three pairs of facets. The open-end wrench includes an open end formed with two jaws at a distance from each other.

In practice, the jaws of the open-end wrench are brought into contact with a pair of facets of the nut or the head of the threaded bolt before the open-end wrench is operated to rotate the nut or the threaded bolt for an angle. The jaws of the open-end wrench are removed from the pair of facets of the nut or the threaded bolt and brought into contact with another pair of facets of the nut or the head of the threaded bolt before the open-end wrench is operated to rotate the nut or the threaded bolt for another angle. This process is repeated to properly engage with the nut with the threaded wrench or disengage the nut from the threaded bolt. The repeated engagement and disengagement are however troublesome.

To solve the above-mentioned problem, various wrenches have been devised. For example, as disclosed in U.S. Pat. No. 8,826,783 issued to the present applicant, a one-way open-end wrench 10 is rotated in a first sense of direction to rotate a threaded bolt 70 for example. The one-way open-end wrench 10 cannot rotate the threaded bolt 70 when the one-way open-end wrench 10 is rotated in a second sense of direction opposite to the first sense of direction. In use, the one-way open-end wrench is alternately rotated in the first and second senses of direction. The one-way open-end wrench 10 includes two jaws 20 and 30 and a swing block 60 connected to the jaw 20. The jaw 30 includes a planar face 31. The swing block 60 includes a planar face 61. The planar faces 31 and 61 are in contact with two parallel sides of a hexagonal head of the threaded bolt 70 when the one-way open-end wrench 10 is rotated in the first sense of direction to rotate the threaded bolt 70. However, such engagement might not be firm. Moreover, the planar faces 31 and 61 are moved past and inevitably wear away angles of the hexagonal head of the threaded bolt 70 when the one-way open-end wrench 10 is rotated in the second sense of direction relative to the threaded bolt 70.

The present invention is therefore intend to obviate or at least alleviate the problems encountered in prior art.

SUMMARY OF INVENTION

It is the primary objective of the present invention to provide a convenient and safe one-way open-end wrench.

To achieve the foregoing objective, the open-end wrench includes a handle and a movable jaw. The handle includes an open end formed with a root, a first stationary jaw extending from the root, and a second stationary jaw extending from the root. The movable jaw is connected to the second stationary jaw and moveable between an idle position and an active position relative to the second stationary jaw. The movable jaw includes an operative face that includes a first planar facet and a second planar facet extending at an angle relative to the first planar facet. The first and second planar facets are respectively in contact with two adjacent sides of a hexagonal head in the active position.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
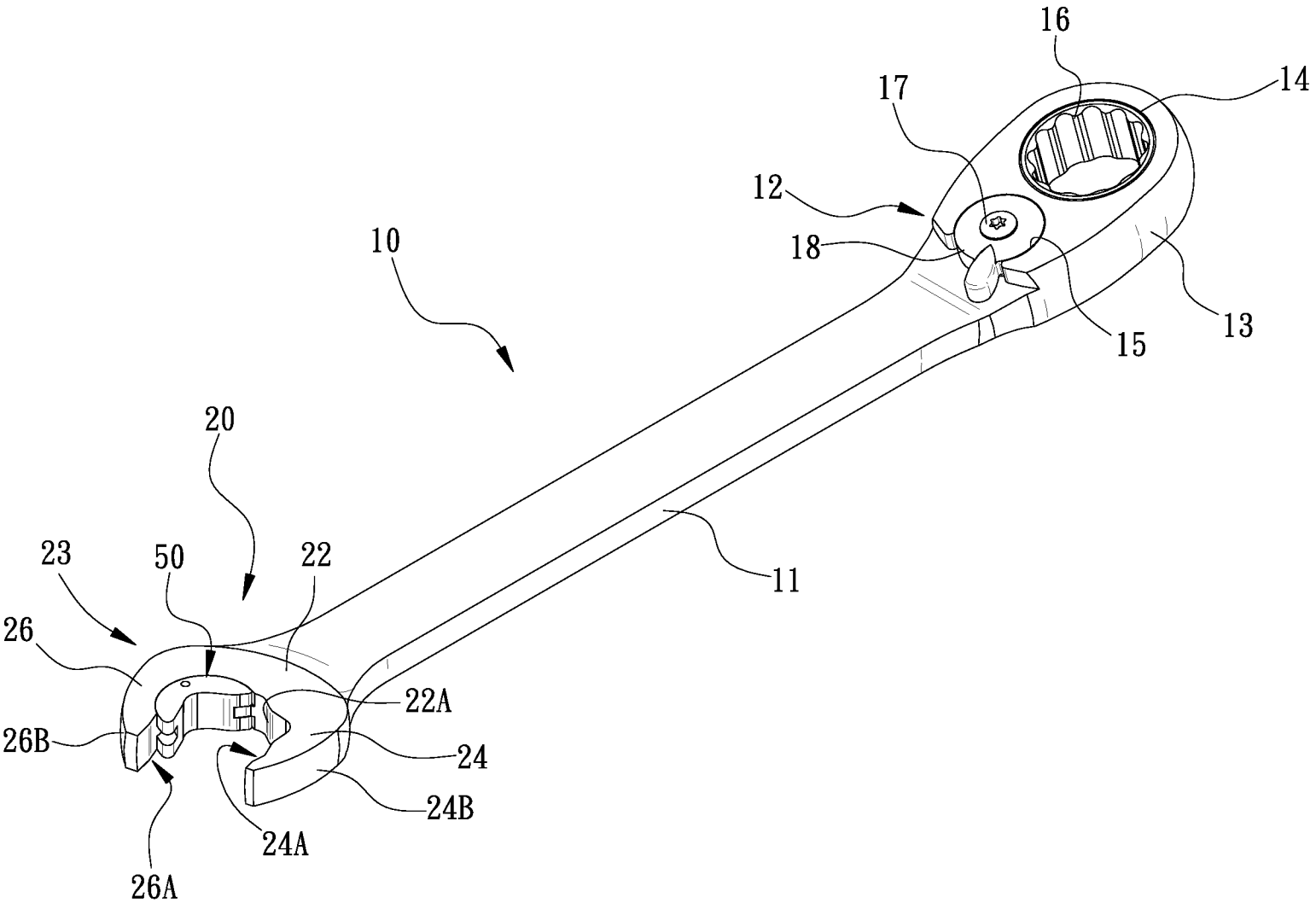
FIG. 1 is a perspective view of a wrench according to the preferred embodiment of the present invention.

Referring to FIG. 1, a wrench 10 includes a handle 11, a box end unit 12 and an open end unit 20 according to the preferred embodiment of the present invention. The handle 11 includes a box end 13 and an open end 23 located opposite to the box end 13. The box end 13 is formed with an opening 14 and a cavity 15. The opening 14 is a circular opening extending throughout the handle 11. That is, the opening 14 includes an open end in a lower face of the handle 11 and another open end in an upper face of the handle 11. The cavity 15 is made in the upper face of the handle 11.

The box end unit 12 includes a toothed wheel 16 inserted in the opening 14 and a switch 18 partially inserted in the cavity 15. The box end unit 12 further includes a selectively one-way transmission (not shown) inserted in the opening 14. A screw 17 is used to connect the switch 18 to the box end 13. The switch 18 is operable to select from two senses of direction in which the box end 13 is allowed to rotate the toothed wheel 16 via the selectively one-way transmission. Thus, the combination of the box end unit 12 with the handle 11 can be used as a selectively one-way wrench.

Figure 3:
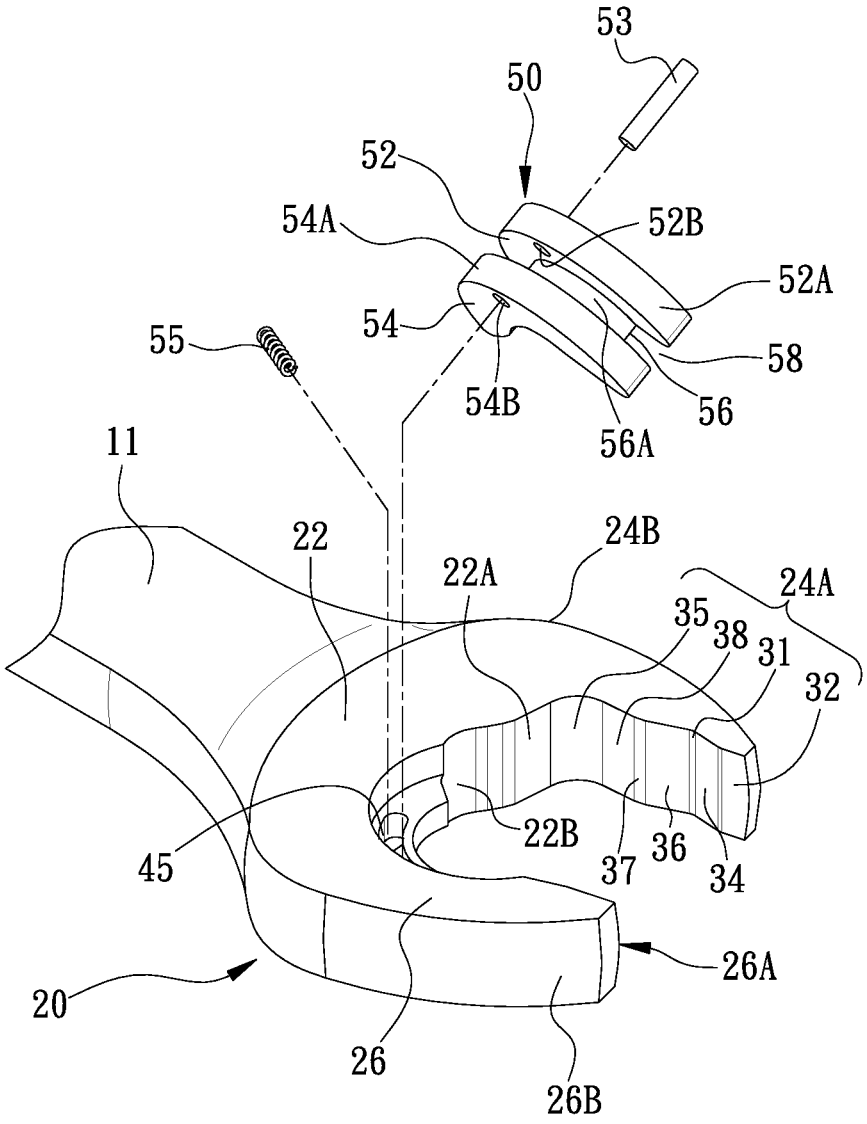
FIG. 3 is another exploded view of the open end of the wrench shown in FIG. 1.
Figure 4:
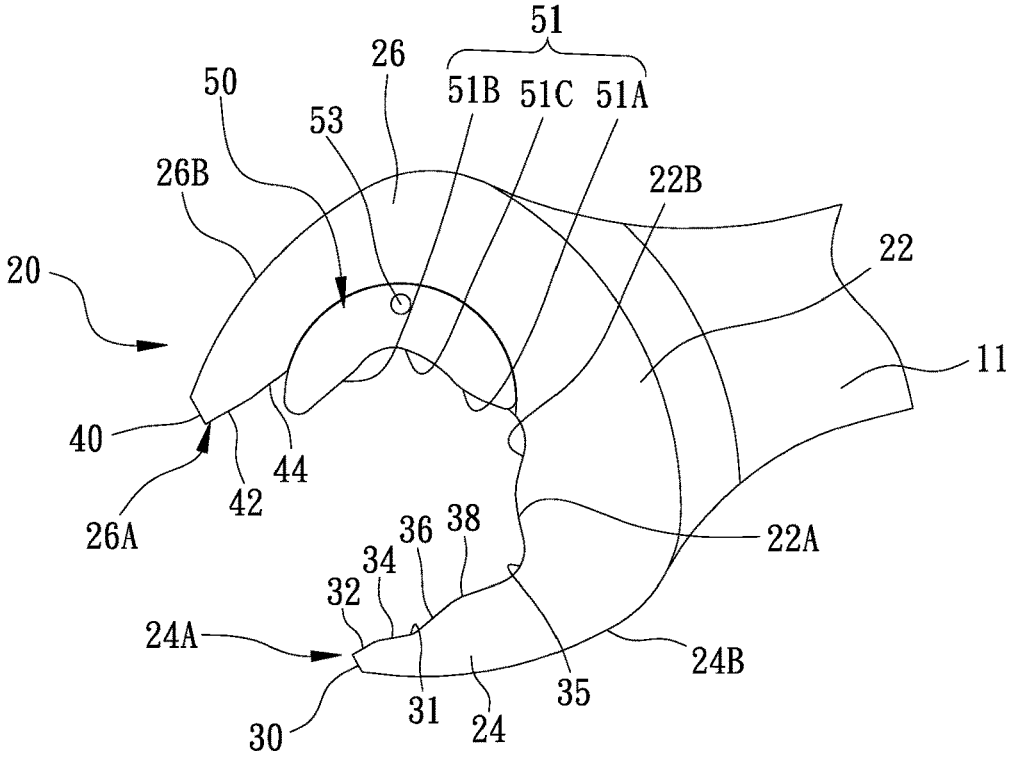
FIG. 4 is a top view of the open end of the wrench shown in FIG. 1.

Referring to FIGS. 1, 3 and 4, the open end unit 20 includes a movable jaw 50 connected to the open end 23 of the handle 11. The open end 23 of the handle 11 includes a root 22 and two stationary jaws 24 and 26 extending from the root 22. The stationary jaws 24 and 26 are located at a distance from each other.

The stationary jaw 24 includes an internal face 24A and an external face 24B. The external face 24B is located substantially opposite to the internal face 24A.

The stationary jaw 26 includes an internal face 26A and an external face 26B. The external face 26B is located substantially opposite to the internal face 26A.

The root 22 includes an internal face extending between the internal faces 24A and 26A. The internal face of the root 22 includes a convex facet 22A adjacent to the internal face 24A and a concave facet 22B adjacent to the internal face 26A.

The stationary jaw 24 further includes a tip 30 where the internal face 24A meets the external face 24B. The internal face 24A includes four facets 32, 34, 36 and 38 arranged sequentially from the tip 30. The facets 32, 34, 36 and 38 are substantially planar facets. There is an apex (not numbered) between the facets 32 and 34. There is an obtuse concave portion 31 between the facets 34 and 36. There is an apex 37 between the facets 36 and 38. A concave portion 35 is located next to the facet 38. The apex 37 is located between the concave portions 31 and 35. The apex 37 is located higher than the concave portions 31 and 35 (FIG. 4). The concave portion 35 is located at a portion of the open end 23 where the root 22 is connected to the stationary jaw 24.

Figure 2:
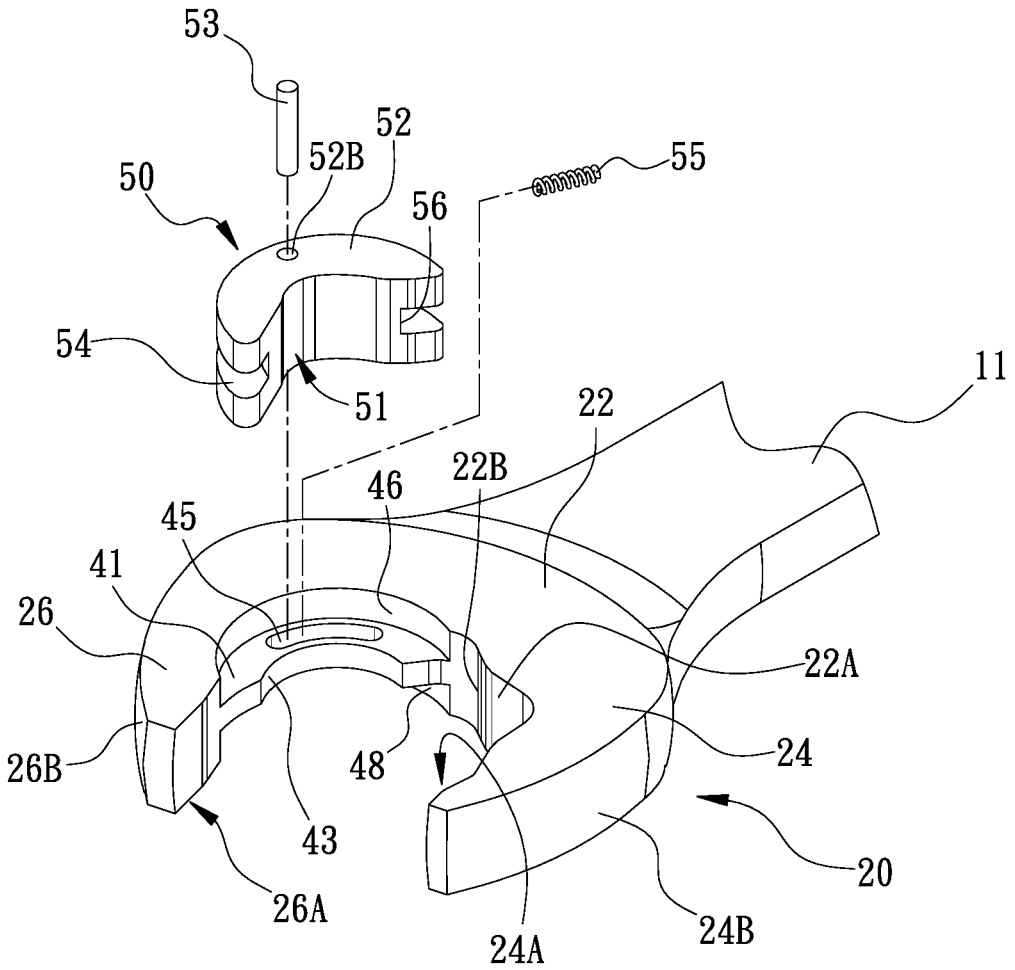
FIG. 2 is an exploded view of an open end of the wrench illustrated in FIG. 1.
Figure 5:
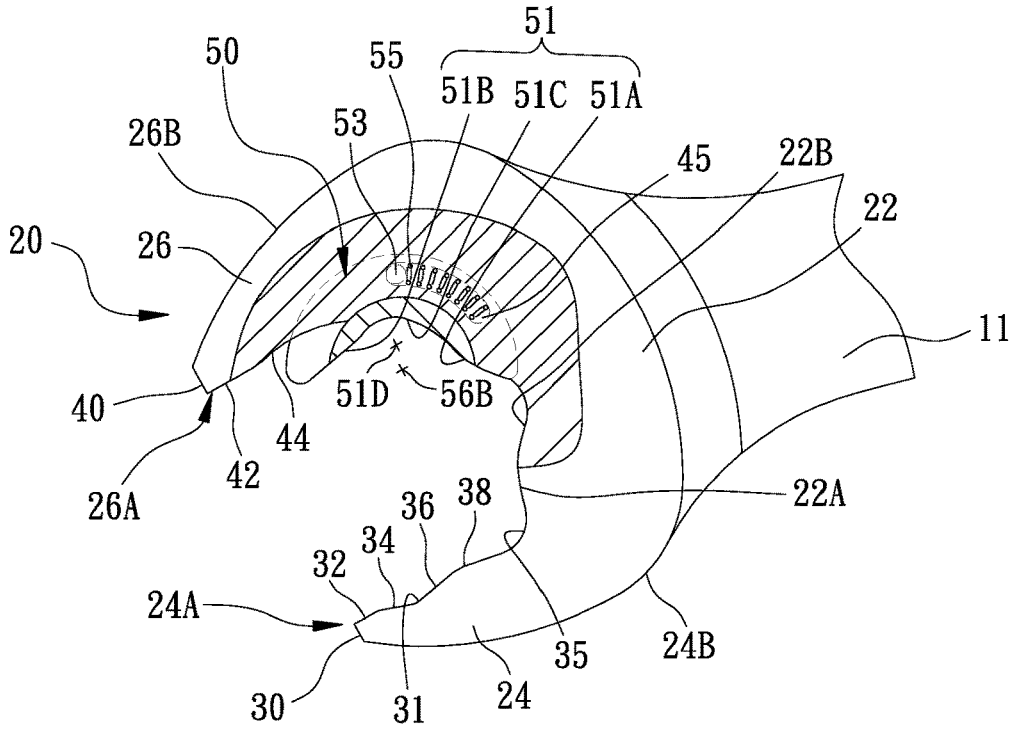
FIG. 5 is a cut-away view of the open end of the wrench illustrated in FIG. 4.

Referring to FIGS. 2, 4 and 5, the stationary jaw 26 further includes a tip 40 where the internal face 26A meets the external face 26B. The internal face 26A includes two facets 42 and 44 sequentially arranged from the tip 40. The facet 42 is a substantially planar facet. The facet 44 is a concave facet. There is an apex (not numbered) between the facets 42 and 44. The facet 44 is located next to the concave facet 22B.

The stationary jaw 26 further includes a track 41 extending on the facet 44, thereby providing two semi-circular cavities 46 and 48 on two opposite sides of the track 41. The track 41 is made with a semi-circular face 43 and a slot 45. The semi-circular face 43 is located opposite to the internal face 24A. The semi-circular cavity 46 is in communication with the semi-circular cavity 48 via the slot 45. The track 41 extends along an arc. The slot 45 extends along another arc. The semi-circular face 43 and the semi-circular cavities 46 and 48 are co-centric. The semi-circular cavities 46 and 48 include a same diameter longer than that of a semi-circular face 43 of the track 41.

Referring to FIGS. 2 through 5, the movable jaw 50 includes two crescent flanges 52 and 54 and a crescent waist 56 formed between the crescent flanges 52 and 54. The crescent flanges 52 and 54 and the crescent waist 56 are co-centric. The crescent flanges 52 and 54 includes a same diameter longer than that of the crescent waist 56. Thus, there is a groove 58 between the crescent flanges 52 and 54. The groove 58 extends along the crescent waist 56. The groove 58 includes two open ends at an operative face 51 of the movable jaw 50. The crescent waist 56 includes a crescent facet 56A extending about a center 56B.

Figure 6:
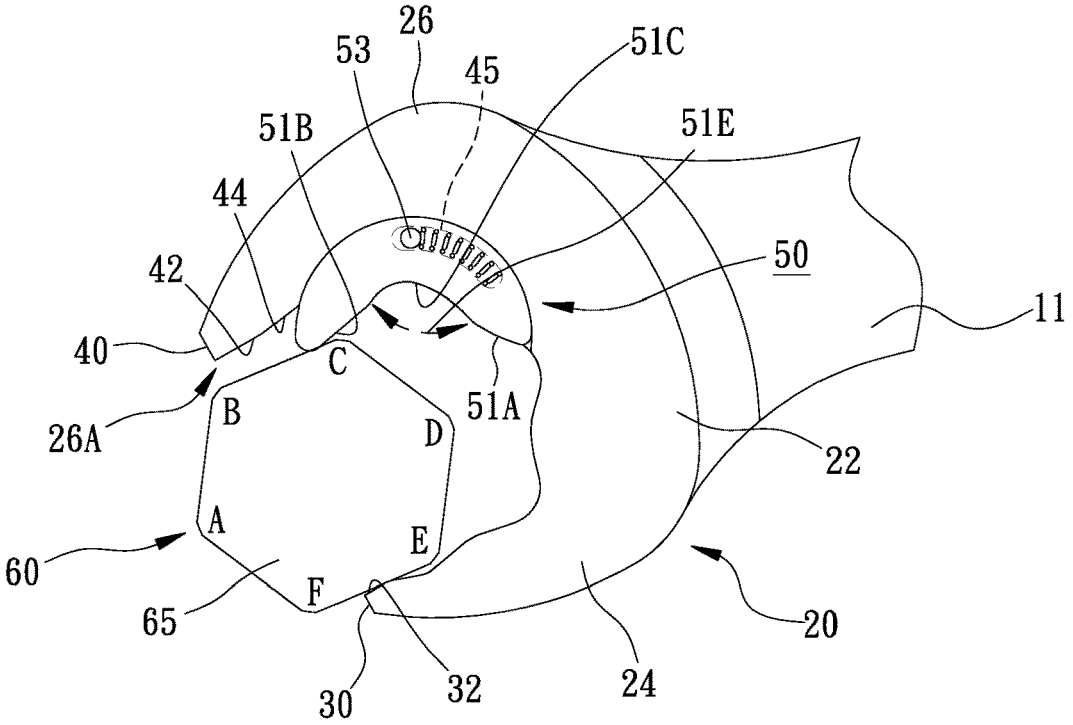
FIG. 6 is a top view of a head of a threaded bolt in a position relative to the open end of the wrench shown in FIG. 4.

The operative face 51 includes three facets 51A, 51B and 51C. The facets 51A and 51B are substantially planar facets. The facet 51A extends at an angle 51E of 120°±10° relative to the facet 51B (FIG. 6). The facet 51C is a concave facet between the facets 51A and 51B. The facet 51C extends about a center 51D different from the center 56B.

The track 41 is inserted in the groove 58. The crescent flanges 52 and 54 are inserted in the semi-circular cavities 46 and 48, respectively. The crescent facet 56A of the crescent waist 56 is in contact with the semi-circular face 43 of the track 41. The facets 52A and 54A of the crescent flanges 52 and 54 are in contact with walls of the semi-circular cavities 46 and 48. Thus, the movable jaw 50 is smoothly movable relative to the stationary jaw 26.

A pin 53 is inserted in an aperture 52B made in the crescent flange 52, an aperture 54B made in the crescent flange 54 and the slot 45 of the track 41. Thus, the movable jaw 50 is connected to the track 41.

A spring 55 is inserted in the arched slot 45 before the track 41 is inserted in the groove 58. An end of the spring 55 is in contact with a first closed end of the arched slot 45 and another end of the spring 55 is in contact with the pin 53 so that the spring 55 biases the movable jaw 50 to a normal operative position relative to the stationary jaw 26. The spring 55 is a helical spring used as a compression spring in the preferred embodiment. However, the spring 55 can be a leaf spring or consists of several discs in another embodiment.

Referring to FIG. 6, a threaded bolt 60 is formed with a hexagonal head 65 that includes six apexes A, B, C, D, E and F and six sides AB, BC, CD, DE, EF and FA. A force is exerted on the handle 11 to move the root 22 toward the hexagonal head 65 of the threaded bolt 60 or a hexagonal nut. The tip 30 and the facet 32 of the stationary jaw 24 are moved past the side BC. The tip 40 and the facet 42 of the stationary jaw 26 are moved past the side EF. The movable jaw 50 is brought into contact with the apex C. Then, the movable jaw 50 is moved by the apex C. The crescent flanges 52 and 54 (FIG. 3) are moved around the crescent waist 56 while the pin 53 is moved in and along the slot 45, thereby compressing the spring 55 (FIG. 5).

Figure 7:
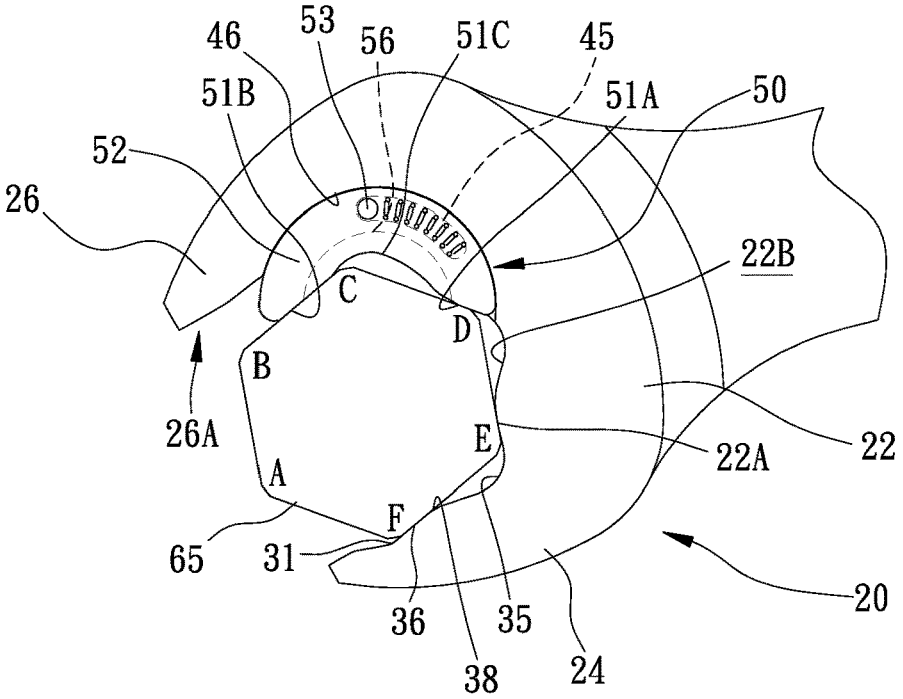
FIG. 7 is a top view of the head of the threaded bolt in another position relative to the open end of the wrench than shown in FIG. 6.

Referring to FIG. 7, the movable jaw 50 is in an operative position. The spring 55 pushes the pin 53 to a second closed end of the arched slot 45. The facet 51A is in contact with the side CD and the facet 51B is in contact with the side BC. The operative face 51 is away from the angle C. The convex facet 22A of the root 22 is in contact with the side DE and the facet 36 of the stationary jaw 24 is in contact with the side EF.

Figure 8:
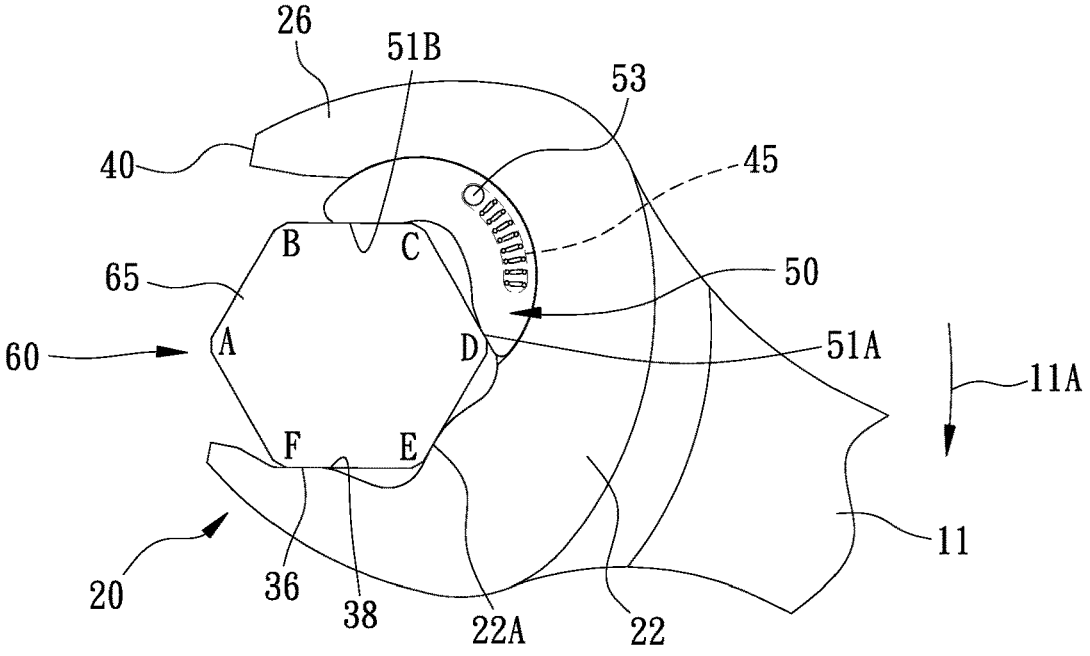
FIG. 8 is a top view of the head of the threaded bolt in another position relative to the open end of the wrench than shown in FIG. 7.

Referring to FIG. 8, the handle 11 is pivoted in a sense of direction indicated by an arrow head 11A. The second closed end of the slot 45 moves the pin 53 and the pin 53 moves the movable jaw 50. Thus, the handle 11 exerts a torque on the hexagonal head 65 via the open end 23 and the open end unit 20 so that the wrench 10 rotates the threaded bolt 60.

Figure 9:
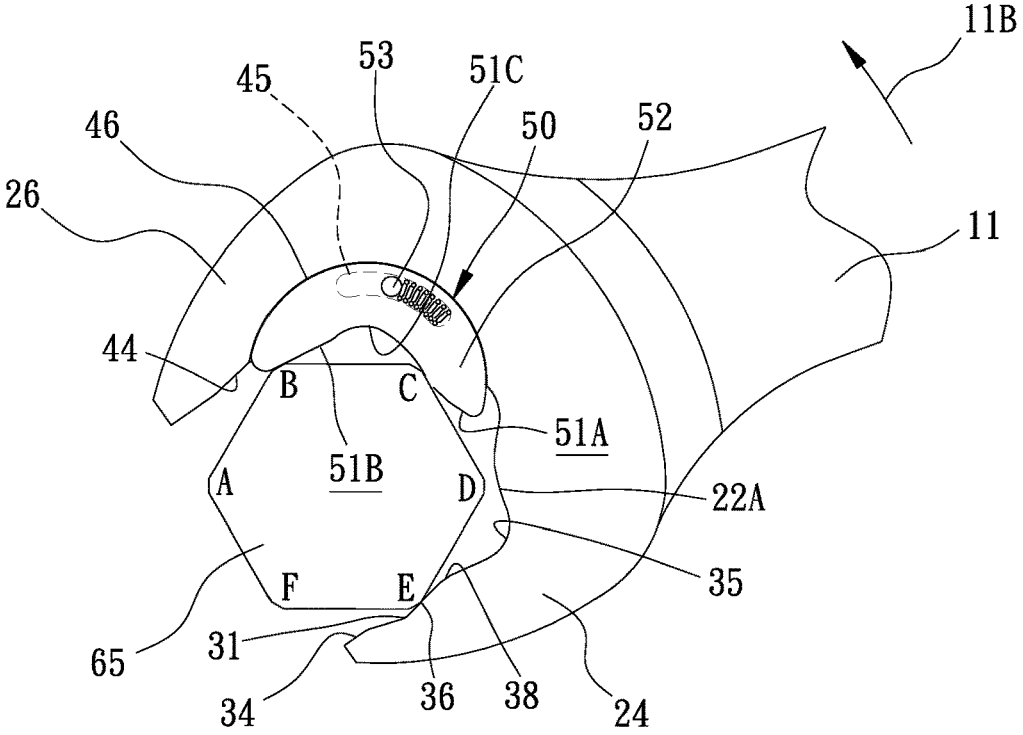
FIG. 9 is a top view of the head of the threaded bolt in another position relative to the open end of the wrench than shown in FIG. 8.

Referring to FIG. 9, the handle 11 is pivoted in a sense of direction indicted by an arrow head 11B, and so is the open end unit 20, which includes the movable jaw 50. The apex 37 is moved past the angle E while the facet 34 of the stationary jaw 24 is kept away from the angle F. The facet 36 is moved past the angle E. The movable jaw 50 is moved toward the angle B past the angle C. The spring 55 is further compressed between the pin 53 and the first closed end of the slot 45.

Figure 10:
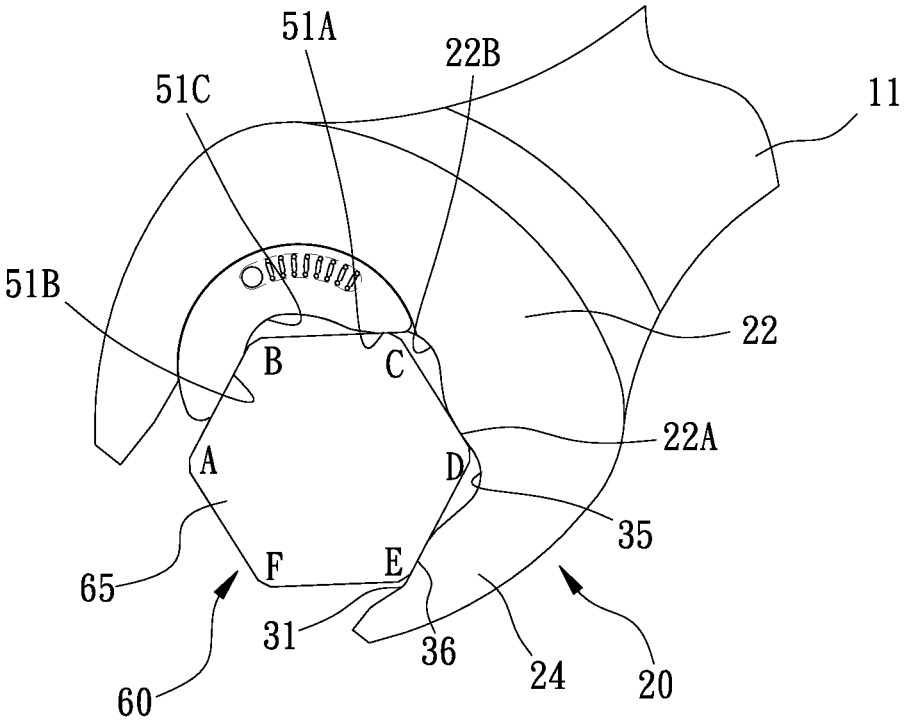
FIG. 10 is a top view of the head of the threaded bolt in another position relative to the open end of the wrench than shown in FIG. 9.

Referring to FIG. 10, the concave portion 35 contains the angle D after it is moved past the angle E. Synchronously, the convex face 22A is in contact with the side CD after it is moved past the side DE. The concave facet 22B is away from the angle C. The spring 55 biases the pin 53, thereby keeping the facet 51B in contact with the side AB and keeping the facet 51A in contact with the side BC Thus, the wrench 10 is ready for rotating the threaded bolt 60 for another angle in the sense of direction indicated by the arrow angle 11A.

The wrench 10 can be flipped for (rotated for 180° about a length of the wrench 10) and pivoted in an opposite sense of direction to loosen the threaded bolt 60 if the wrench 10 is pivoted in the sense of direction indicated by the arrow head 11A to tighten the threaded bolt 60.

The wrench 10 of the present invention exhibits several advantages over the prior art. Firstly, the engagement of the wrench 10 with the threaded bolt 60 is firm in a tightening stroke because they are in contact with each other in areas as shown in FIG. 8. Secondly, the stationary jaw 24 and the movable jaw 50 wear away the hexagonal head of the threaded bolt 60 relatively slowly due to the internal face 24A of the stationary jaw 24 and the concave facet 51C of the movable jaw 50 referring to FIG. 9.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An open-end wrench comprising:

a handle comprising an open end formed with a root, a first stationary jaw extending from the root, a second stationary jaw extending from the root, a track extending on the second stationary jaw, and a slot in the track, wherein the slot comprises a first closed end and a second closed end; and an open end unit comprising:

a movable jaw comprising two crescent flanges and a groove between the crescent flanges to receive the track;

a pin inserted in the movable jaw and the slot in the track on the second stationary jaw so that the movable jaw is connected to the second stationary jaw, wherein the pin is movable along the slot so that the movable jaw is moveable between an idle position and an active position relative to the second stationary jaw; and a spring inserted in the slot and compressed between the pin and the first closed end of the slot so that the movable jaw is kept in the active position by the spring;

wherein the movable jaw comprises an operative face that comprises a first planar facet and a second planar facet extending at a first angle relative to the first planar facet, wherein the first and second planar facets are configured to respectively contact two adjacent sides of a hexagonal head in the active position when in use.

2. The open-end wrench according to claim 1, wherein the first angle is 120°±10°.

3. The open-end wrench according to claim 1, wherein the operative face of the movable jaw further comprises a concave portion extending between the first and second planar facets.

4. The open-end wrench according to claim 1, wherein the spring is a helical spring.

5. The open-end wrench according to claim 1, wherein the first stationary jaw comprises an internal face comprising:

a first planar facet extending near a tip of the first stationary jaw;

a second planar facet extending at a second angle relative to the first planar facet of the first stationary jaw;

a third planar facet extending at a third angle relative to the second planar facet of the first stationary jaw, thereby forming an obtuse concave portion between the second and third planar facets of the first stationary jaw;

a fourth planar facet extending at a fourth angle relative to the third planar facet of the first stationary jaw thereby providing an apex between the third and fourth planar facets of the first stationary jaw;

a concave portion formed next to the fourth planar facet of the first stationary jaw wherein the apex and the third and fourth planar facets of the first stationary jaw are located between the obtuse concave portion and the concave portion, the concave portion is located next to an internal face of the root.

* * * * *